US008116497B2

(12) United States Patent
Li

(10) Patent No.: US 8,116,497 B2
(45) Date of Patent: Feb. 14, 2012

(54) PORTABLE SPEAKER SYSTEM FOR OUTDOOR UMBRELLA

(76) Inventor: Wanda Ying Li, Santa Ana, CA (US)

( * ) Notice: Subject to any disclaimer, the term of this patent is extended or adjusted under 35 U.S.C. 154(b) by 1211 days.

(21) Appl. No.: 11/827,732

(22) Filed: Jul. 13, 2007

(65) Prior Publication Data

US 2009/0014041 A1 Jan. 15, 2009

(51) Int. Cl.
*H04R 1/02* (2006.01)

(52) U.S. Cl. ..... 381/332; 381/87; 381/386; 135/15.1; 135/16; 135/98

(58) Field of Classification Search ..... 381/124, 381/87, 334, 386, 332; 135/16, 15.1, 98
See application file for complete search history.

(56) References Cited

U.S. PATENT DOCUMENTS 5,584,564 A * 12/1996 Phyle ..... 362/102
2003/0002688 A1* 1/2003 Kanevsky et al. ..... 381/74
2003/0102021 A1* 6/2003 Cohen et al. ..... 135/16
2004/0256852 A1* 12/2004 Benedict ..... 280/806
2008/0095382 A1* 4/2008 Mott et al. ..... 381/55
2008/0238270 A1* 10/2008 Wayman et al. ..... 312/199
2008/0292120 A1* 11/2008 Wilson ..... 381/300

* cited by examiner

*Primary Examiner* — Devona Faulk
*Assistant Examiner* — Disler Paul
(74) *Attorney, Agent, or Firm* — Raymond Y. Chan; David and Raymond Patent Firm

(57) ABSTRACT

A portable system for an outdoor umbrella includes a portable housing, a detachable locker, and an audio device. The portable housing includes a first housing body and a second housing body defining a mounting slot for a shaft of the outdoor umbrella fitting therewithin. The detachable locker includes a first locker provided at the first housing body and a second locker which is provided at the second housing body and is releasably locked with the first locker so as to detachably lock up the second housing body with the first housing body. The audio device includes a speaker supported in the first housing body and an audio input operatively coupling with the speaker such that when the audio input sends an audio signal to the speaker, the speaker is adapted for producing audio sound as an additional function for the outdoor umbrella.

3 Claims, 9 Drawing Sheets

PORTABLE SPEAKER SYSTEM FOR OUTDOOR UMBRELLA

BACKGROUND OF THE PRESENT INVENTION

1. Field of Invention

The present invention relates to an outdoor umbrella, and more particularly to a portable speaker system which is adapted to detachably mount to a conventional outdoor umbrella so as to provide an add-on function for the conventional outdoor umbrella without altering its original structure.

2. Description of Related Arts

Outdoors umbrellas are set up in many places such as in beach areas, in patio areas, in campsites or in domestic gardens etc. They are usually used for shading sunlight in the daytime. A conventional outdoors umbrella usually comprises an umbrella base, a supporting stem upwardly extended therefrom, a foldable awning frame which comprises a plurality of awning supporting arms radically and outwardly extended from an upper end portion of the supporting stem, and a fabric-made awning securely and foldably mounted on the awning supporting arms.

Users would always like to listen to the music at their leisure such that the users usually carry a portable music player. However, such portable music player cannot be mounted to the outdoor umbrella. In other words, most of the users prefer the outdoor umbrella with built-in audio system. Actually, mounting an audio system on the outdoors umbrella is a challenging task. Not to mention the problems arise when one tries to design the mechanical connection between the audio system and the outdoors umbrella without interfering its smooth folding action, it is the problem as how to provide the audio system with enough and convenient power source which simply possesses the main difficulty in designing a practical audio system.

Since the outdoors umbrellas, as the name implies, are designed for use in outdoors, existence of an electrical power source cannot be guaranteed. Even through there are electrical sources exist, a tedious connection between the audio system and the electrical source is unavoidable in that long wires have to be used. For some cases, the audio systems may be compatible with portable dynamos, however, bring a bulky dynamo with the outdoor umbrella is not really a wise decision. Once the electrical connection the audio system is broken, the user is unable to replace the audio system. In other words, once the audio system is malfunction, the mood of all the participants may be ruined.

As a matter of fact, the very purpose of using outdoors umbrella is to shade vigorous sunlight. Therefore, it would be more economical, more convenient and more environmentally friendly if one were able to detachably add an additional audio system to any conventional outdoor umbrella for providing an add on function thereto without alternating the original structure of the outdoor umbrella.

SUMMARY OF THE PRESENT INVENTION

A main object of the present invention is to provide a portable speaker system for an outdoor umbrella, wherein the portable speaker system is adapted to detachably mount to a conventional outdoor umbrella so as to provide an add-on function for the conventional outdoor umbrella without altering its original structure.

Another object of the present invention is to provide a portable speaker system for an outdoor umbrella, wherein no electric wire is required to electrically connect the audio system with the outdoor umbrella. In other words, the portable speaker system provides an independent power supply such that the audio system does not require any power supply from the outdoor umbrella.

Another object of the present invention is to provide a portable speaker system for an outdoor umbrella, wherein the audio system is adapted to detachably mount to any type of outdoor umbrella having an elongated shaft. Therefore, the user is able to mount the portable speaker system from one outdoor umbrella to another outdoor umbrella easily.

Another object of the present invention is to provide a portable speaker system for an outdoor umbrella, wherein the portable speaker system does not significantly alter the original structure of the outdoors umbrella, so as to minimize the manufacturing and marketing costs of the portable speaker system incorporating with the outdoor umbrella.

Another object of the present invention is to provide a portable speaker system for an outdoor umbrella, wherein no complicated mechanical and electrical processes are involved in installing and mounting the portable speaker system on the outdoor umbrella.

Another object of the present invention is to provide a portable speaker system for an outdoor umbrella, wherein the portable speaker system further provides an added lighting function for providing illumination.

Accordingly, in order to accomplish the above objects, the present invention provides a portable speaker system for an outdoor umbrella having a shaft, comprising:

a portable housing which comprises a first housing body and a second housing body defining a mounting slot when the first and second housing bodies are coupled with each other, wherein the mounting slot has a size for the shaft of the outdoor umbrella fitting therewithin;

a detachable locker comprising a first locker provided at the first housing body and a second locker which is provided at the second housing body and is releasably locked with the first locker so as to detachably lock up the second housing body with the first housing body; and an audio device which comprises a speaker supported in the first housing body and an audio input operatively coupling with the speaker such that when the audio input sends an audio signal to the speaker, the speaker is adapted for producing audio sound as an additional function for the outdoor umbrella.

These and other objectives, features, and advantages of the present invention will become apparent from the following detailed description, the accompanying drawings, and the appended claims.

DETAILED DESCRIPTION OF THE PREFERRED EMBODIMENT

Figure 1:
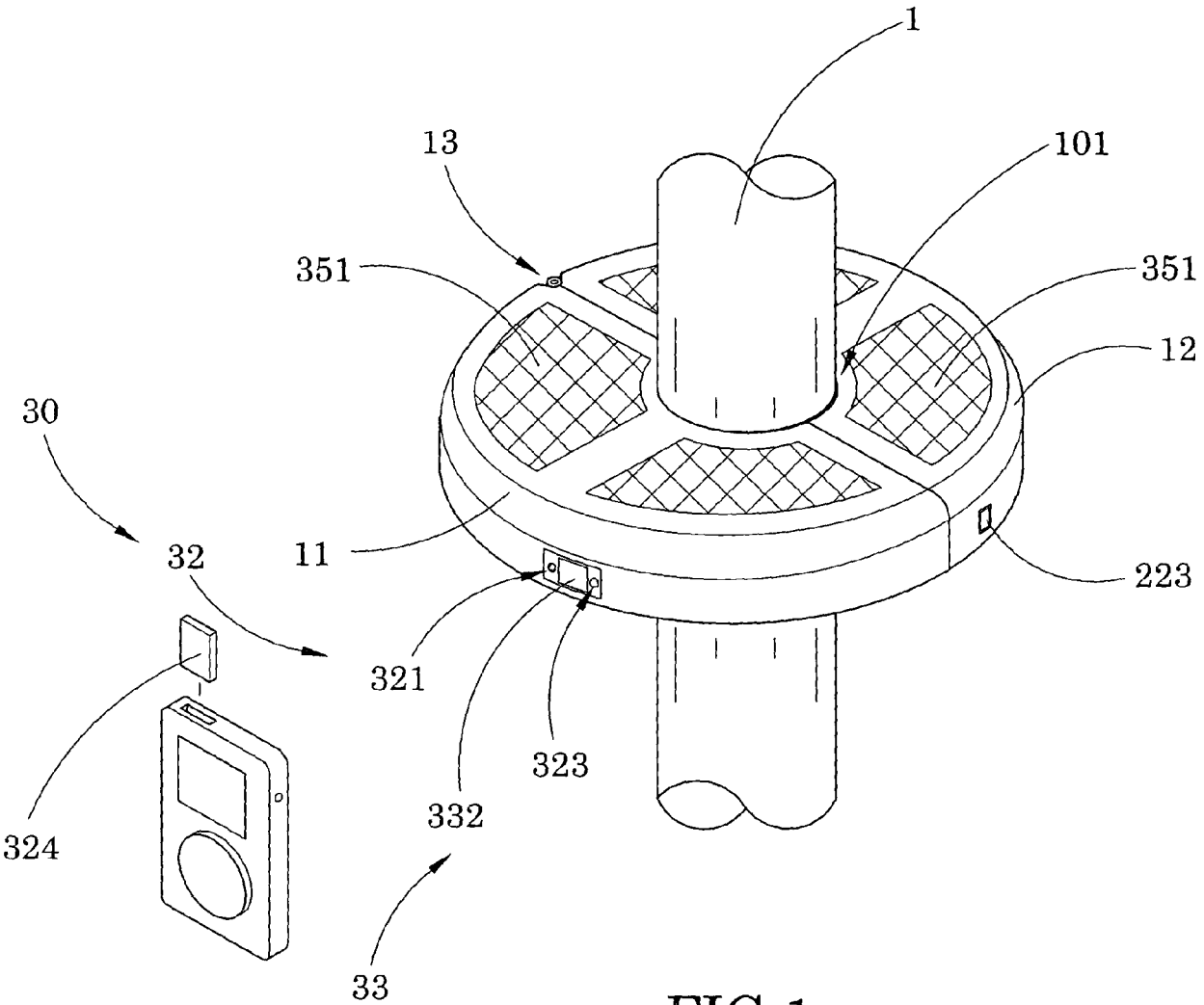
FIG. 1 is a top perspective view of a portable speaker system for an outdoor umbrella according to a preferred embodiment of the present invention.
Figure 2:
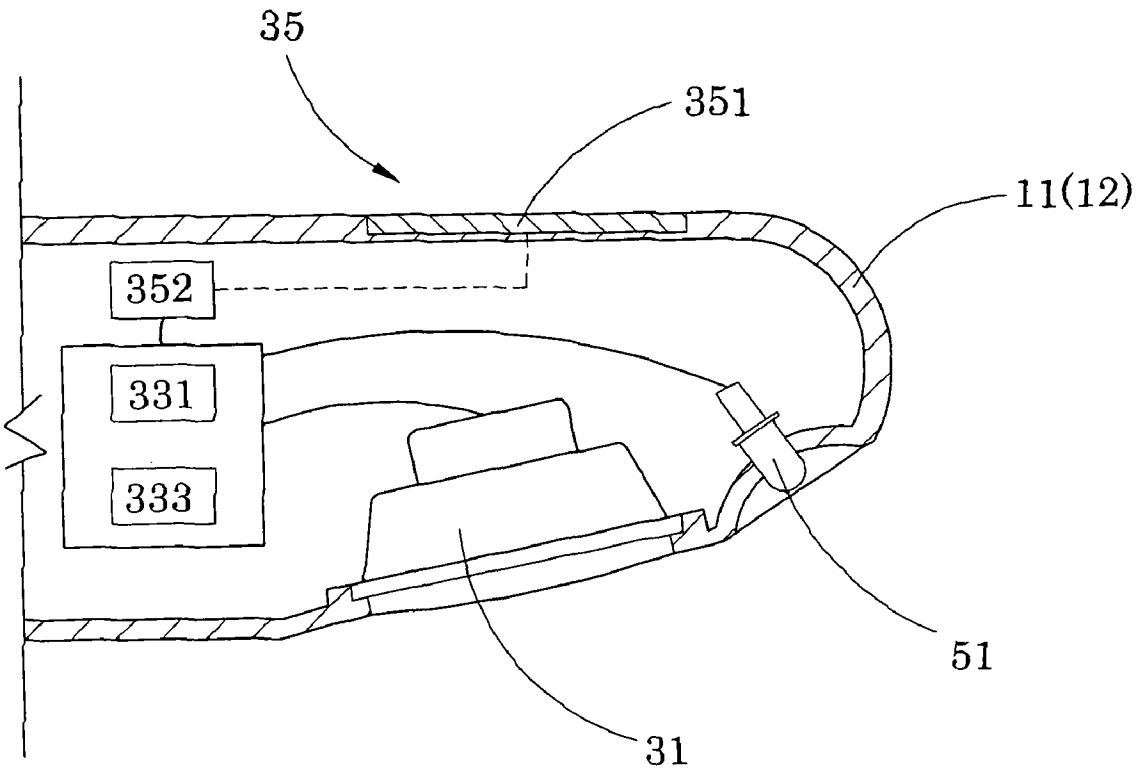
FIG. 2 is a partially schematic view of the portable speaker system according to the above preferred embodiment of the present invention.
Figure 7:
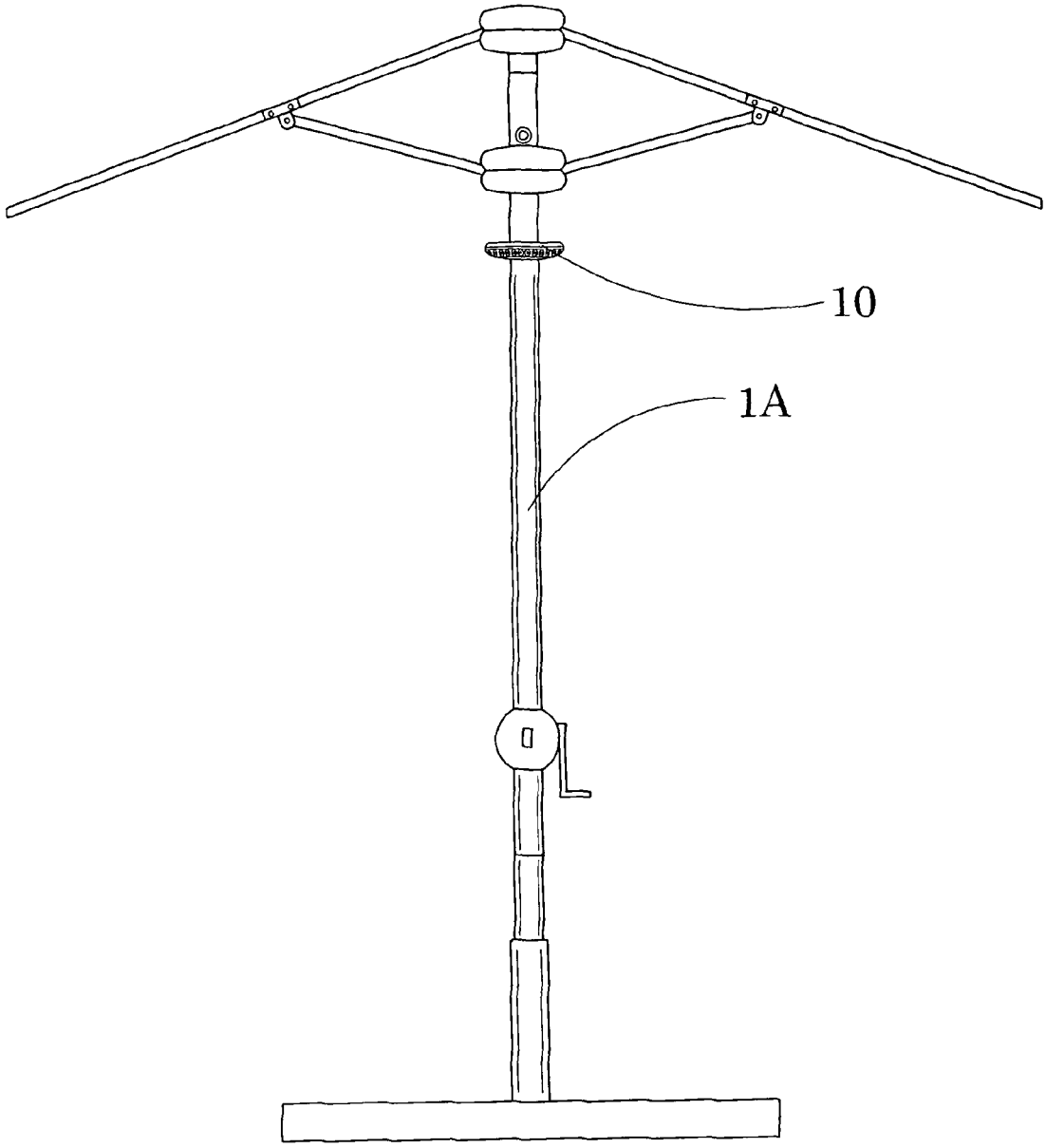
FIG. 7 illustrates the portable speaker system of the present invention being mounted to the supporting shaft of the outdoor umbrella.
Figure 8:
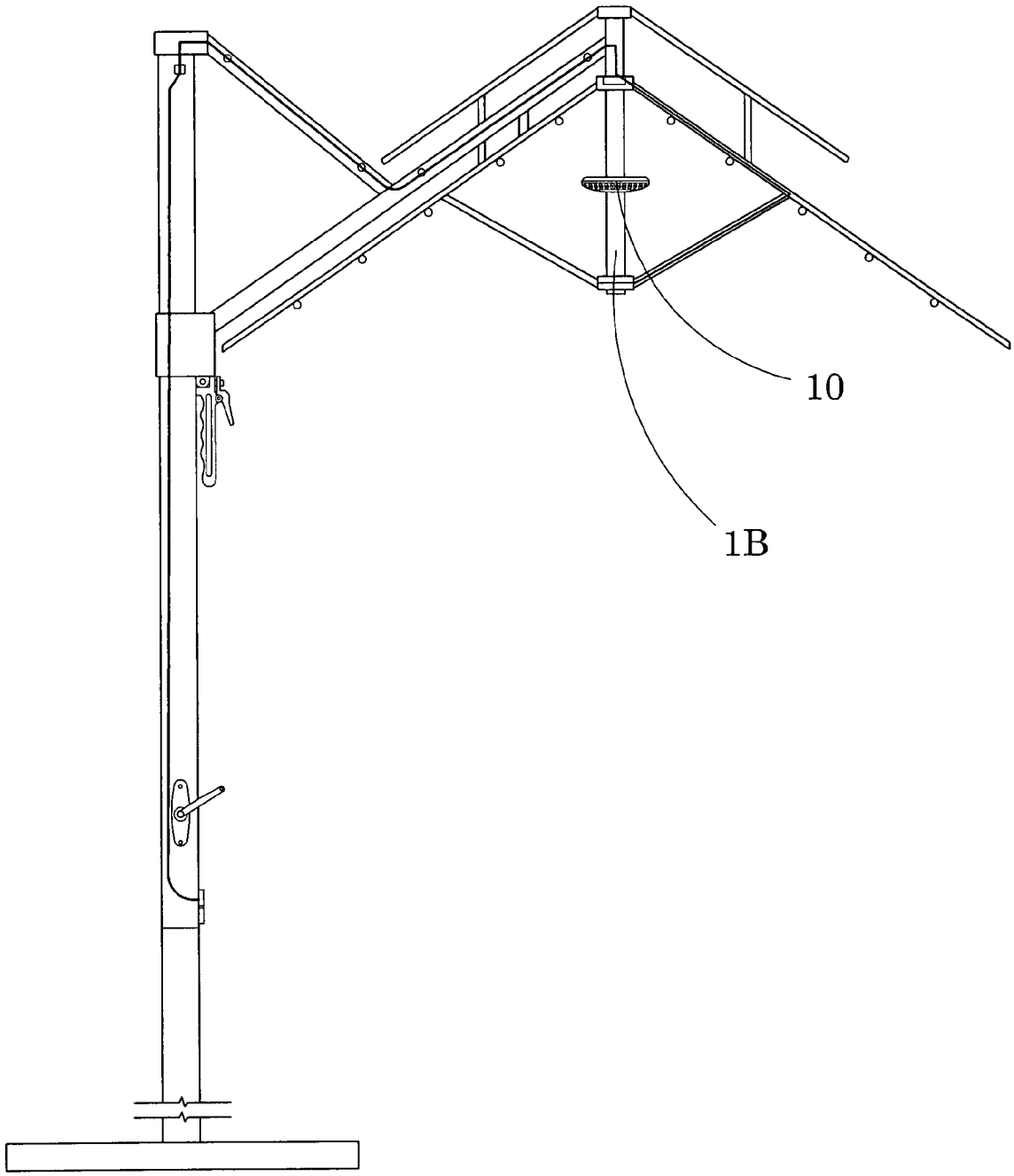
FIG. 8 illustrates the portable speaker system of the present invention being mounted to the upper portion of the awning shaft of the outdoor umbrella.
Figure 9:
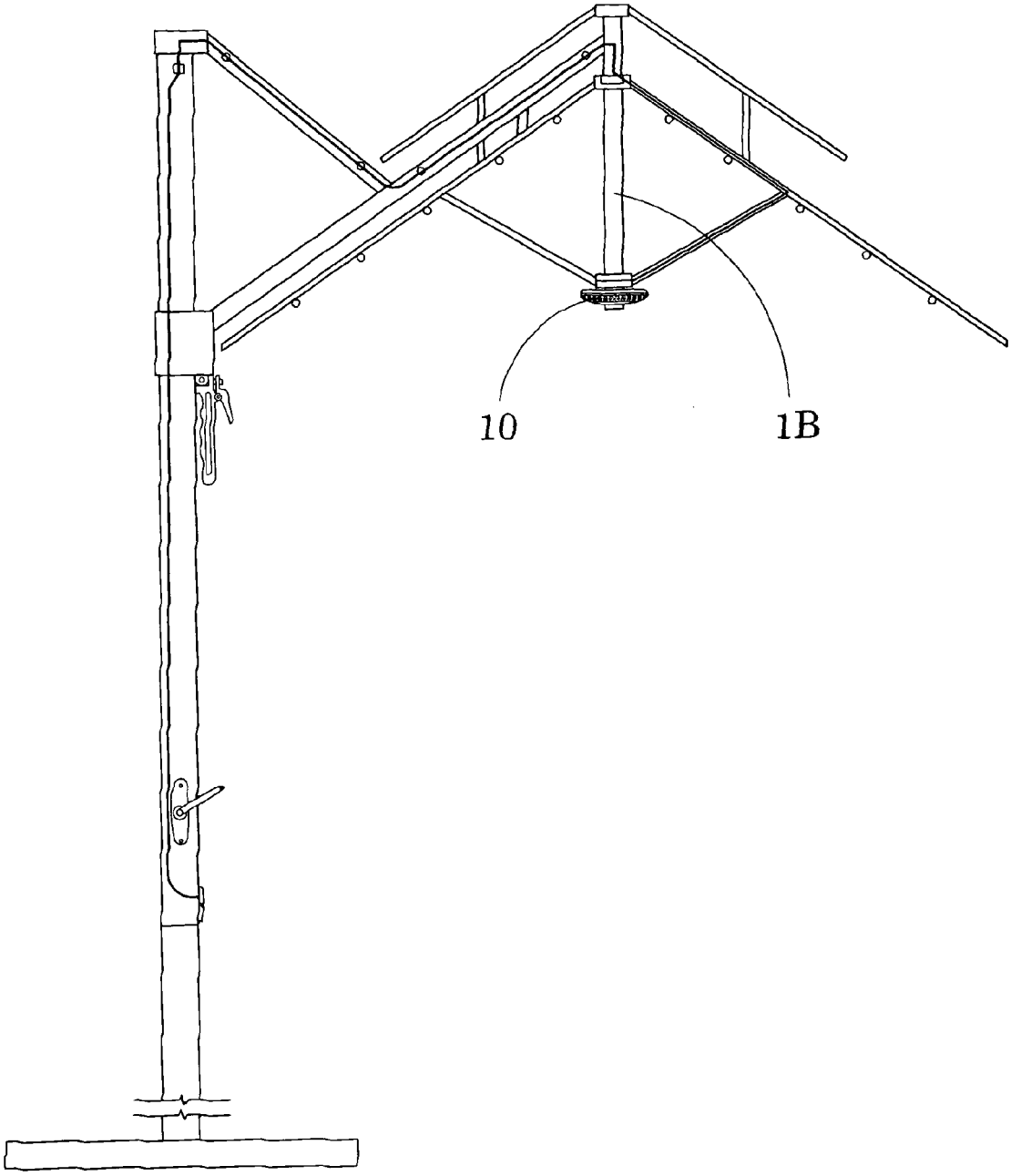
FIG. 9 illustrates the portable speaker system of the present invention being mounted to the lower portion of the supporting shaft of the outdoor umbrella.

Referring to FIGS. 1 and 2 of the drawings, a portable speaker system for an outdoor umbrella is illustrated, wherein the portable speaker system is adapted to detachably mount to the shaft 1 of the outdoor umbrella. As shown in FIG. 7 the portable speaker system of the present invention is detachably mounted to the supporting shaft 1A of the outdoor umbrella. As shown in FIGS. 8 and 9, the portable speaker system of the present invention is detachably mounted to the upper and lower portions of the awning shaft 1B of the outdoor umbrella.

According to the preferred embodiment, the portable speaker system comprises a portable housing 10, a detachable locker 20 and an audio device 30.

Figure 3:
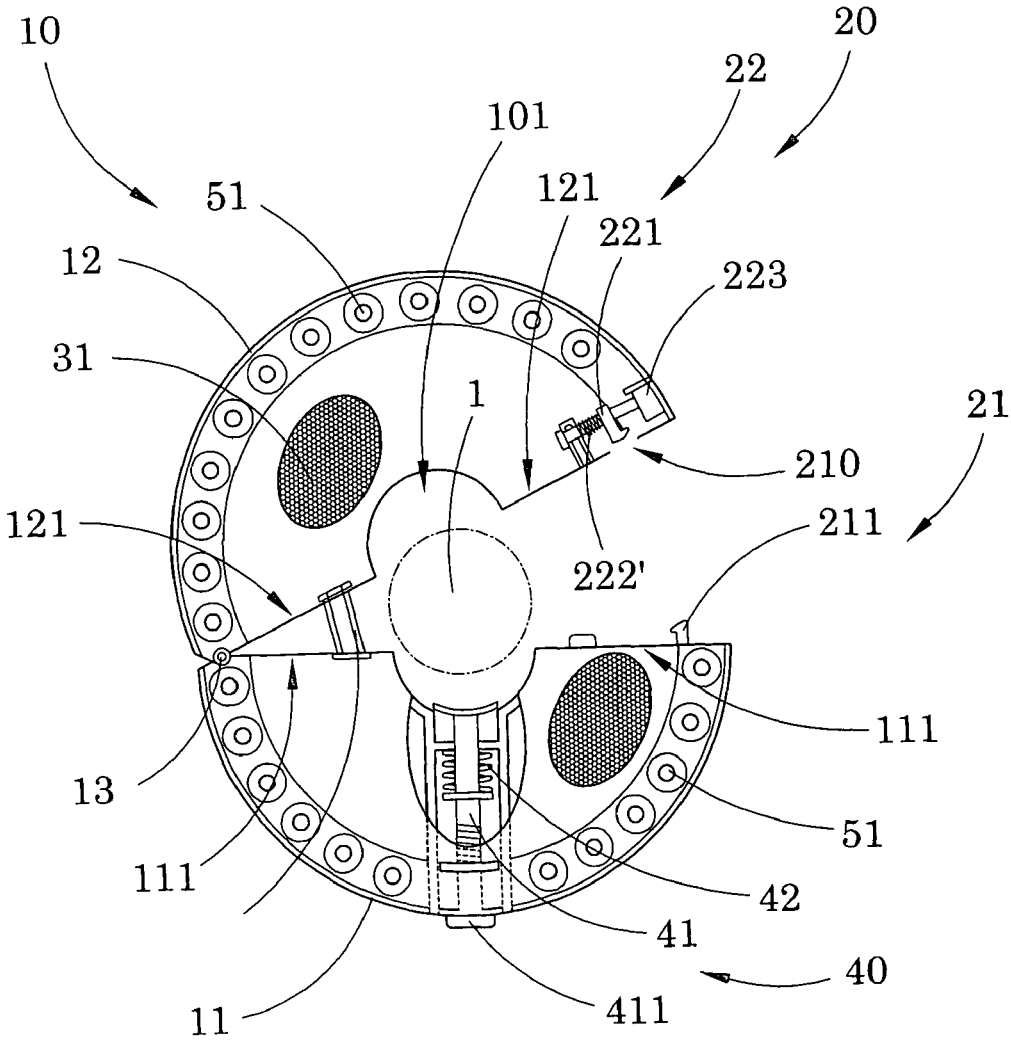
FIG. 3 is a bottom view of the portable speaker system according to the above preferred embodiment of the present invention, illustrating the first and second housing bodies being pivotally coupled with each other via a pivot hinge.

As shown in FIG. 3, the portable housing 10 comprises a first housing body 11 and a second housing body 12 defining a mounting slot 101 when the first and second housing bodies 11, 12 are coupled with each other, wherein the mounting slot 101 has a size for the shaft 1 of the outdoor umbrella fitting therewithin.

The detachable locker 20 comprises a first locker 21 provided at the first housing body 11 and a second locker 22 which is provided at the second housing body 12 and is releasably locked with the first locker 21 so as to detachably lock up the second housing body 11 with the first housing body 12.

The audio device 30 comprises two or more speakers 31 supported in the first and second housing bodies 11, 12 of the portable housing 10 respectively and an audio input 32 operatively coupling with the speakers 31 such that when the audio input 32 sends an audio signal to the speakers 31, the speakers 31 are adapted for producing audio sound as an additional function for the outdoor umbrella.

As shown in FIG. 3, the first and second housing bodies 11, 12 are two identical half circular bodies pivotally coupling with each other via a pivot hinge 13, wherein each of the first and second housing bodies 11, 12 has two biasing surfaces 111, 121 arranged when the biasing surfaces 111 of the first housing body 11 engage with the biasing surfaces 121 of the second housing body 12 respectively, the portable housing 10 is formed to have a donut shape and to define the mounting slot 101 at a center of the portable housing 10.

The portable speaker system further comprises a lighting device 50 for providing illumination under the portable housing 10. The lighting device 50 comprises a plurality of illuminators 51 spacedly supported in the outer circumferential portion of the first and second housing bodies 11, 12 and electrically coupling with the audio device 30'. Accordingly, each of the illuminators 51 is a LED having a head portion protruded from the bottom sides of the first and second housing bodies 11, 12 and a tail portion electrically connecting to the audio device 30.

The first locker 21 comprises a first locking latch 211 outwardly protruded from one of the biasing surfaces 111 of the first housing body 11. The second locker 22 comprises a second locking latch 221 movably supported in the second housing body 12 to align with a locking hole 210 on the respective biasing surface 121 of the second housing body 12, wherein when the first locking latch 211 is engaged with the second is locking latch 221 through the locking hole 210, the second housing body 12 is locked up with the first housing body 11.

Accordingly, the second locker 22 further comprises a resilient element 222 supported in the second housing body 12 for applying an urging force against the second locking latch 221 so as to normally retain the second locking latch 221 being locked up with the first locking latch 211, and a lock actuator 223 coupling with the second locking latch 221 and actuating the second locking latch 221 to disengage with the first locking latch 211. The resilient element 222 is a compression spring having two ends coupling with an inner wall of the second housing body 12 and the second locking latch 221 to apply the urging force against the second locking latch 221. The lock actuator 223 is coupled with the second locking latch 221 such that when the lock actuator 223 is actuated, the second locking latch 221 is driven to move to disengage with the first locking latch 221 so as to unlock the second housing body 12 from the first housing body 11. Once the lock actuator 223 is released from its actuated position, the resilient element 222 drives the second locking latch 221 backs to its original position.

According to the embodiment, there are two speakers 31 spacedly mounted in the first and second housing bodies 11, 12 for generating the audio sound in stereo manner. Accordingly, the portable housing 10 has an audio outlet formed at a bottom side of each of the first and second housing bodies 11, 12, wherein the speakers 31 are aligned with the audio opening for outputting the audio sound through the audio outlet.

The audio input 32 comprises an auxiliary input 321 provided on the portable housing for communicatively connecting a portable music player to receive the audio signal therefrom, such that the audio signal is transmitted to the speakers 31 for music broadcasting. Preferably, the auxiliary input 321 is provided on the outer surface of the first housing body 11 for the user to connect the portable music player to the speakers 31.

The audio input 32 further a wireless receiver 323 supported in the portable housing 10 to electrically connect with the speakers 31 and a wireless transmitter 324 which is wirelessly linked with the wireless receiver 323 and is adapted for connecting with the portable music player to wirelessly sending the audio signal from the portable music player to the speakers 31 for music broadcasting. Accordingly, the wireless receiver 323 is a FM receiver and the wireless transmitter 324 is a FM transmitter such that the wireless receiver 323 and the wireless transmitter 324 form a wireless link to wirelessly send the audio signal from the portable music player to the speakers 31. Therefore, when the wireless transmitter 324 is tuned automatically or manually to match the radio frequency of the wireless receiver 323, the audio device 30 is wirelessly connected with the portable music player. Accordingly, the portable housing 10 further comprises a device holder 14 provided at the first housing body 11 for detachably holding the portable music player in position, wherein the device holder 14 comprises a plurality of holder arms 141 spacedly extended from a top side of the first housing body 11 to define a holding compartment for securely receiving the portable music player therein.

The audio device 30 further comprises a control panel 33 which is provided at the portable housing 10, comprising a control circuitry 331 operatively connecting to the speakers 31 to selectively operate and control the speaker and a display screen 332 electrically connected to the control circuitry 331 for displaying an operation status thereof. It is worth to mention that the control circuitry 331 is also operatively connected to the wireless receiver 323 to operate and control the wireless receiver 323. Accordingly, a remote controller can be incorporated to remote control the audio device 30.

The control panel 33 further comprises a radio broadcasting circuit 333 for receiving radio wave as the audio signal, such that the control panel 33 transmits the audio signal to the speakers 31 for radio broadcasting. In other words, the user is able to listen to the music from his or her portable music player or to the radio through the portable speaker system of the present invention.

The audio device 30 further comprises a power supply 35 supported by the portable housing 10 to electrically connect with the speakers 31 and the control panel 33. As shown in FIG. 2, the power supply 35 comprises a solar energy collector 351 for collecting solar energy and a rechargeable battery 352 supported in one of the first and second housing bodies 11, 12 for storing electrical energy converted from the solar energy, such that the audio device 30 does not require any electrical power from the outdoor umbrella. Alternatively, the power supply 35 can be electrically connected to the power source of the outdoor umbrella, especially the outdoor umbrella incorporating with a solar energy.

As shown in FIG. 1, the solar energy collector 351 comprises a plurality of solar collecting panels provided on a top side of the portable housing 10 for solar energy collection. It is worth to mention that the user is able to charge the rechargeable battery 352 by facing the solar energy collector 351 towards the sunlight such that the portable housing 10 is adapted to be mounted at the shaft 1 of the outdoor umbrella as an add-on speaker without any electrical connection to the outdoor umbrella.

As shown in FIG. 3, the speakers 31 are supported in the first and second housing bodies 11, 12 respectively, wherein an electric cable 311 are extended between the two corresponding biasing surfaces 111, 121 of the first and second housing bodies 11, 12 to electrically connect the speakers 31 with each other. Accordingly, the electric cable 311 not only electrically connects the speakers 31 with each other but also limits a pivot angle between the first and second housing bodies 11, 12.

Figure 4:
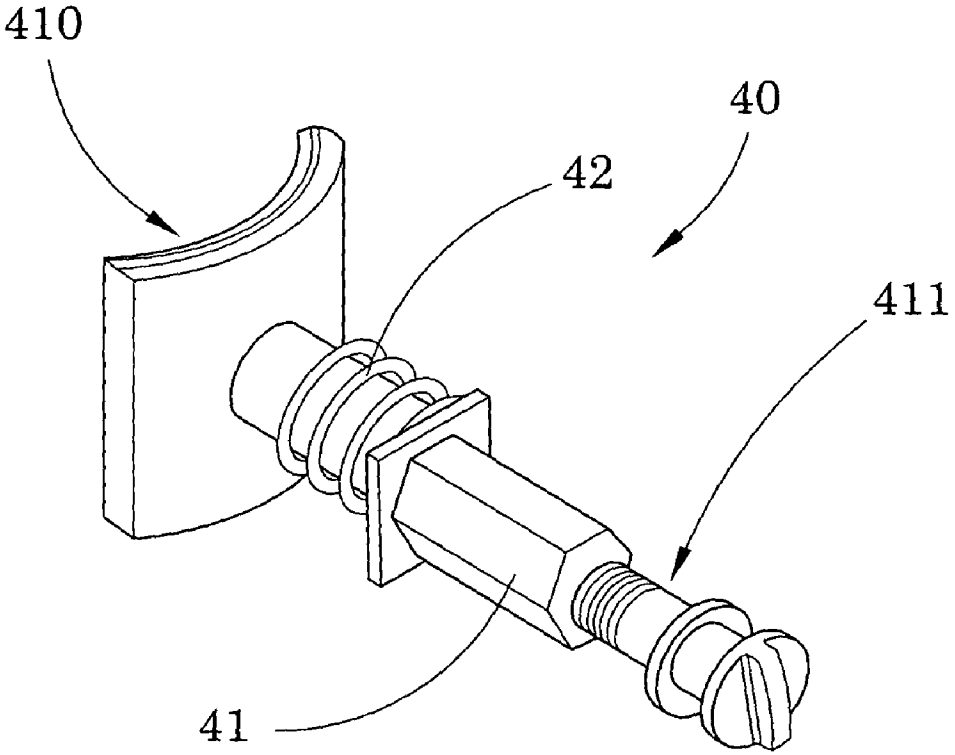
FIG. 4 is a sectional view of the adjustable retainer according to the above preferred embodiment of the present invention.

The portable speaker system, according to the preferred embodiment, further comprises an adjustable retainer 40 for adjusting the size of the mounting slot 101 for the shaft 1 of the outdoor umbrella. The adjustable retainer 40 comprises a retention arm 41 having a pusher surface 410 facing towards the mounting slot 101 and a control portion 411 rotatably coupling with the second housing body 12 such that when the control portion 411 is driven to rotate, the pusher surface 410 is adjustably move to adjust the size of the mounting slot 101. As shown in FIG. 4, the control portion 411 of the retention arm 41 has an outer threaded portion engaging with an inner threaded portion of a sidewall of the second housing body 12. The adjustable retainer 40 further comprises a compression spring 42 coaxially mounted at the retention arm 41 for applying an urging force against the retention arm 41 to push the pusher surface 410 away from the mounting slot 101. In other words, when the control portion 411 of the retention arm 41 is rotated to move the pusher surface 410 towards the mounting slot 101', the compression spring 42 is being compressed.

Figure 5:
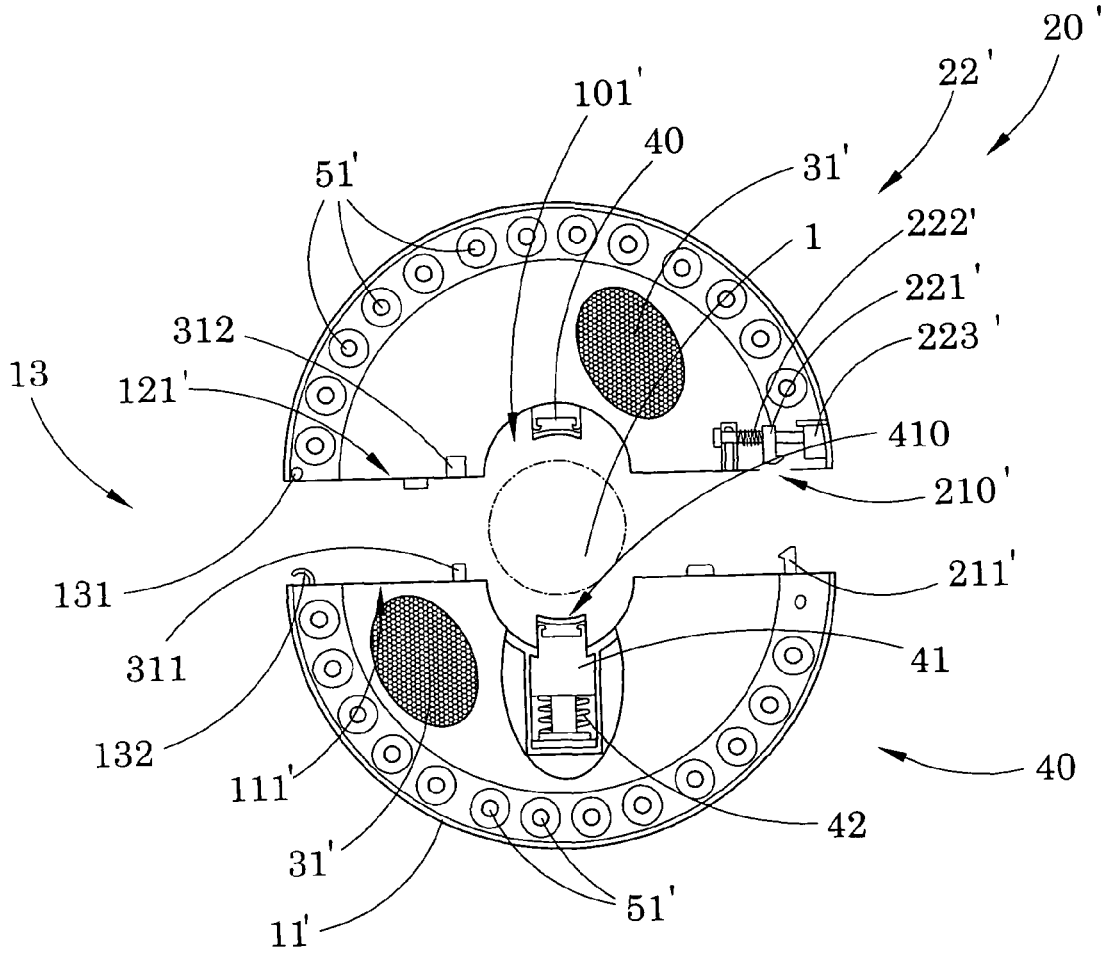
FIG. 5 illustrates an alternative mode of the pivot hinge according to the above preferred embodiment of the present invention, illustrating the first and second housing bodies being detached with each other via a pivot hinge.

FIG. 5 illustrates an alternative mode of the pivot hinge 13'. As shown in FIG. 5, the first housing body 11' is pivotally coupled with the second housing body 12' via a pivot hinge 13'. The pivot hinge 13' comprises a pivot shaft 131' provided at the first housing body 11' and a detachable coupler 132' which is extended from the second housing body 11' and is detachably coupled with the pivot shaft 131' to pivotally connect the second housing body 12' with the first housing body 11'. Therefore, once the detachable coupler 132' couples with the pivot shaft 131', the first and second housing bodies 11', 12 are pivotally moved with respect to the pivot shaft 131'. In other words, the pivot hinge 13' not only pivotally connects the first and second housing bodies 11', 12' with each other but also detachably mounts the first and second housing bodies 11', 12' with each other.

The adjustable retainer 40' comprises a retention arm 41', having a pusher surface 410' facing towards the mounting slot 101', slidably mounted the first housing body 11' and an adjustable locker 42' controllably driving the retention arm 41' at a position that when the retention arm 41' is driven towards mounting slot 101', the pusher surface 410' is arranged for biasing against an outer surface of the shaft 1 of the outdoor umbrella until the shaft 1 thereof being fitted at the mounting slot 101' so as to substantially mount the portable housing 10' at the outdoor umbrella.

Figure 6:
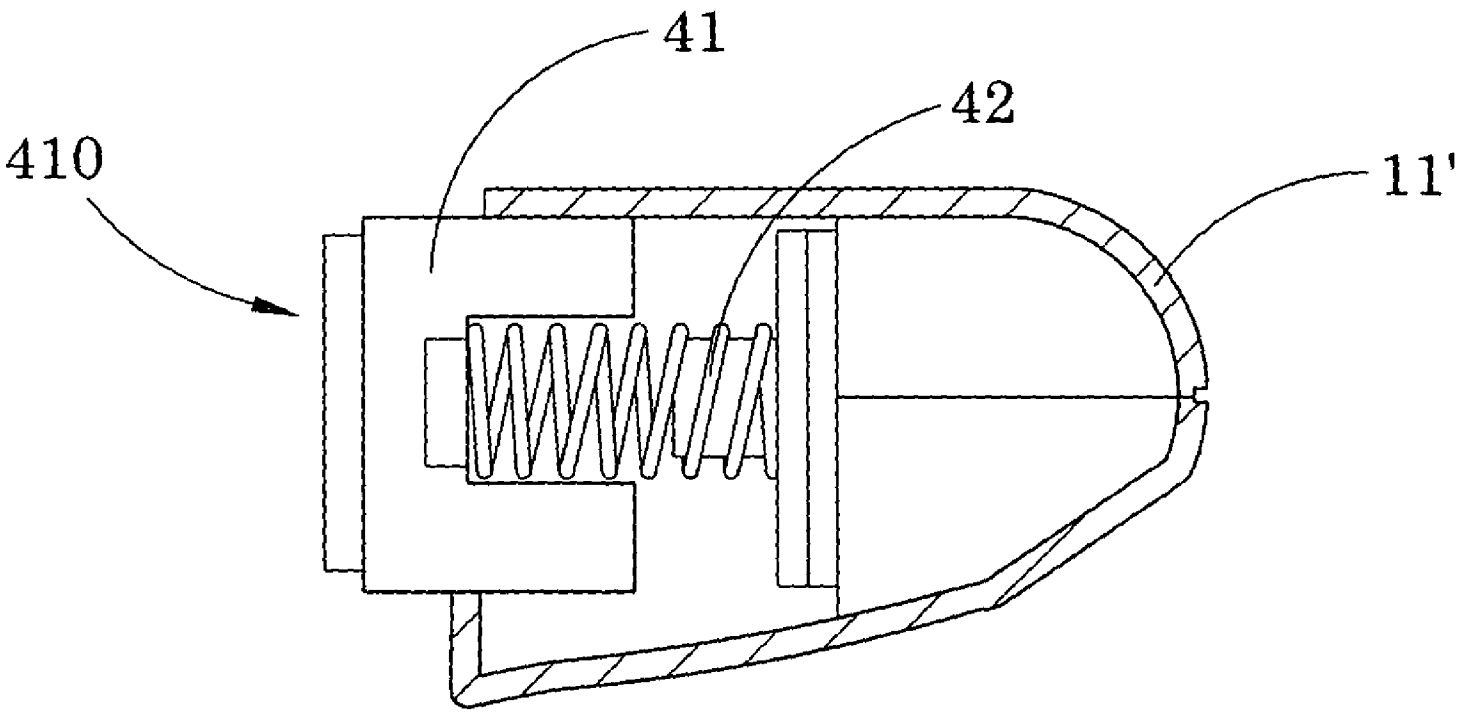
FIG. 6 illustrates an alternative mode of the adjustable retainer according to the above preferred embodiment of the present invention.

As shown in FIG. 6, The adjustable retainer 42' comprises a compression spring supported in the first housing body 11' for applying a pushing force against the retention arm 41' so as to normally push the pusher surface 410' towards the mounting slot 101'.

In addition, since the first housing body 11' can be detached from the second housing body 12' via the pivot hinge 13', the electric cable 311 should be omitted. In order to electrically connect the speakers 31' at the first and second housing bodies 11', 12', an electric plug 311' is extended from the corresponding biasing surface 111' of the first housing body 11' and is electrically coupled with the speaker 31' thereat. An electric socket 312' is extended from the corresponding biasing surface 121' of the second housing body 12' and is electrically coupled with the speaker 31' thereat, wherein the electric plug 311' is electrically coupled to the electric socket 312' when the first and second housing bodies 11', 12' are coupled with each other via the pivot hinge 13'.

One skilled in the art will understand that the embodiment of the present invention as shown in the drawings and described above is exemplary only and not intended to be limiting.

It will thus be seen that the objects of the present invention have been fully and effectively accomplished. The embodiments and their alternatives have been shown and described for the purposes of illustrating the functional and structural principles of the present invention and is subject to change without departure from such principles. Therefore, this invention includes all modifications encompassed within the spirit and scope of the following claims.

What is claimed is:

1. A portable speaker system for an outdoor umbrella having a shaft, comprising:

a portable housing which comprises a first housing body and a second housing body defining a mounting slot when said first and second housing bodies are coupled with each other, wherein said mounting slot has a size for said shaft of said outdoor umbrella fitting therewithin;

a detachable locker comprising a first locker provided at said first housing body and a second locker which is provided at said second housing body and is releasably locked with said first locker to detachably lock up said second housing body with said first housing body for securely mounting said portable housing around said shaft of said outdoor umbrella;

an audio device which comprises two or more speakers supported in said first and second housing bodies of said portable housing respectively and an audio input operatively coupling with said speaker such that when said audio input sends an audio signal to said speakers, said speakers are adapted for producing audio sound as an additional function for said outdoor umbrella; and an adjustable retainer for adjusting the size of said mounting slot for said shaft of said outdoor umbrella, wherein said adjustable retainer comprises a retention arm, having a pusher surface facing towards said mounting slot, slidably mounted said first housing body and an adjustable locker controllably driving said retention arm at a position that when said retention arm is driven towards mounting slot, said pusher surface is arranged for biasing against an outer surface of said shaft of said outdoor umbrella until said shaft thereof being fitted at said mounting slot so as to substantially mount said portable housing at said outdoor umbrella, wherein said adjustable locker comprises a compression spring supported in said first housing body for applying a pushing force against said retention arm so as to normally push said pusher surface towards said mounting slot.

2. A portable speaker system for an outdoor umbrella having a shaft, comprising:

a portable housing which comprises a first housing body and a second housing body defining a mounting slot when said first and second housing bodies are coupled with each other, wherein said mounting slot has a size for said shaft of said outdoor umbrella fitting therewithin;

a detachable locker comprising a first locker provided at said first housing body and a second locker which is provided at said second housing body and is releasably locked with said first locker to detachably lock up said second housing body with said first housing body for securely mounting said portable housing around said shaft of said outdoor umbrella;

an audio device which comprises two or more speakers supported in said first and second housing bodies of said portable housing respectively and an audio input operatively coupling with said speaker such that when said audio input sends an audio signal to said speakers, said speakers are adapted for producing audio sound as an additional function for said outdoor umbrella; and an adjustable retainer for adjusting the size of said mounting slot for said shaft of said outdoor umbrella, wherein said adjustable retainer comprises a retention arm, having a pusher surface facing towards said mounting slot, slidably mounted said first housing body and an adjustable locker controllably driving said retention arm at a position that when said retention arm is driven towards mounting slot, said pusher surface is arranged for biasing against an outer surface of said shaft of said outdoor umbrella until said shaft thereof being fitted at said mounting slot so as to substantially mount said portable housing at said outdoor umbrella, wherein said adjustable locker comprises a compression spring supported in said first housing body for applying a pushing force against said retention arm so as to normally push said pusher surface towards said mounting slot;

wherein said audio input comprises an auxiliary input provided on said portable housing for communicatively connecting to a portable music player to receive said audio signal therefrom, such that said audio signal is transmitted to said speakers for music broadcasting;

wherein said audio device further comprises a control panel, which is provided at said portable housing, comprising a control circuitry operatively connecting to said speakers to selectively operate and control said speakers and a display screen electrically connected to said control circuitry for displaying an operation status thereof;

wherein said control panel comprises a radio broadcasting circuit for receiving radio wave as said audio signal, such that said control panel transmits said audio signal to said speakers for radio broadcasting;

wherein said first and second housing bodies are two identical half circular bodies pivotally coupling with each other via a pivot hinge, wherein each of said first and second housing bodies has two biasing surfaces arranged when said biasing surfaces of said first housing body engage with said biasing surfaces of said second housing body respectively, said portable housing is formed to have a donut shape and to define said mounting slot at a center of said portable housing;

wherein said pivot hinge comprises a pivot shaft provided at said first housing body and a detachable coupler which is extended from said second housing body and is detachably coupled with said pivot shaft to pivotally connect said second housing body with said first housing body;

wherein said audio device further comprises an electric plug which is extended from said corresponding biasing surface of the first housing body and is electrically coupled with said speaker thereat, and an electric socket which is extended from said corresponding biasing surface of said second housing body and is electrically coupled with said speaker thereat, wherein said electric plug is electrically coupled to said electric socket when said first and second housing bodies are coupled with each other to electrically connect said speakers with each other.

3. A portable speaker system for an outdoor umbrella having a shaft, comprising:

a portable housing which comprises a first housing body and a second housing body defining a mounting slot when said first and second housing bodies are coupled with each other, wherein said mounting slot has a size for said shaft of said outdoor umbrella fitting therewithin;

a detachable locker comprising a first locker provided at said first housing body and a second locker which is provided at said second housing body and is releasably locked with said first locker to detachably lock up said second housing body with said first housing body for securely mounting said portable housing around said shaft of said outdoor umbrella;

an audio device which comprises two or more speakers supported in said first and second housing bodies of said portable housing respectively and an audio input operatively coupling with said speaker such that when said audio input sends an audio signal to said speakers, said speakers are adapted for producing audio sound as an additional function for said outdoor umbrella; and an adjustable retainer for adjusting the size of said mounting slot for said shaft of said outdoor umbrella, wherein said adjustable retainer comprises a retention arm, having a pusher surface facing towards said mounting slot, slidably mounted said first housing body and an adjustable locker controllably driving said retention arm at a position that when said retention arm is driven towards mounting slot, said pusher surface is arranged for biasing against an outer surface of said shaft of said outdoor umbrella until said shaft thereof being fitted at said mounting slot so as to substantially mount said portable housing at said outdoor umbrella, wherein said adjustable locker comprises a compression spring supported in said first housing body for applying a pushing force against said retention arm so as to normally push said pusher surface towards said mounting slot;

wherein said audio input comprises an auxiliary input provided on said portable housing for communicatively connecting to a portable music player to receive said audio signal therefrom, such that said audio signal is transmitted to said speakers for music broadcasting;

wherein said audio device further comprises a control panel, which is provided at said portable housing, comprising a control circuitry operatively connecting to said speakers to selectively operate and control said speakers and a display screen electrically connected to said control circuitry for displaying an operation status thereof;

wherein said control panel comprises a radio broadcasting circuit for receiving radio wave as said audio signal, such that said control panel transmits said audio signal to said speakers for radio broadcasting;

wherein said first and second housing bodies are two identical half circular bodies pivotally coupling with each other via a pivot hinge, wherein each of said first and second housing bodies has two biasing surfaces arranged when said biasing surfaces of said first housing body engage with said biasing surfaces of said second housing body respectively, said portable housing is formed to have a donut shape and to define said mounting slot at a center of said portable housing;

wherein said pivot hinge comprises a pivot shaft provided at said first housing body and a detachable coupler which is extended from said second housing body and is detachably coupled with said pivot shaft to pivotally connect said second housing body with said first housing body;

wherein said audio device further comprises an electric plug which is extended from said corresponding biasing surface of the first housing body and is electrically coupled with said speaker thereat, and an electric socket which is extended from said corresponding biasing surface of said second housing body and is electrically coupled with said speaker thereat, wherein said electric plug is electrically coupled to said electric socket when said first and second housing bodies are coupled with each other to electrically connect said speakers with each other;

wherein said first locker comprises a first locking latch outwardly protruded from one of said biasing surfaces of said first housing body, wherein said second locker comprises a second locking latch movably supported in said second housing body to align with a locking hole on said respective biasing surface of said second housing body, wherein when said first locking latch is engaged with said second locking latch through said locking hole, said second housing body is locked up with said first housing body;

wherein said second locker further comprises a resilient element supported in said second housing body for applying an urging force against said second locking latch so as to normally retain said second locking latch being locked up with said first locking latch, and a lock actuator coupling with said second locking latch and actuating said second locking latch to disengage with said first locking latch.

* * * * *